US008191296B2

(12) United States Patent
Xu

(10) Patent No.: US 8,191,296 B2
(45) Date of Patent: Jun. 5, 2012

(54) ELEVATING BILLBOARD AND CONTROL METHOD THEREOF

(76) Inventor: Peiyuan Xu, Ningbo (CN)

( * ) Notice: Subject to any disclaimer, the term of this patent is extended or adjusted under 35 U.S.C. 154(b) by 375 days.

(21) Appl. No.: 12/509,439

(22) Filed: Jul. 25, 2009

(65) Prior Publication Data

US 2010/0018097 A1 Jan. 28, 2010

(30) Foreign Application Priority Data

Jul. 25, 2008 (CN) ..... 2008 1 0063716

(51) Int. Cl.

| | |
|---|---|
| ***G09F 15/00*** | (2006.01) |
| ***G09F 7/00*** | (2006.01) |
| ***A47H 1/10*** | (2006.01) |
| ***B65D 55/14*** | (2006.01) |
| ***E05B 65/06*** | (2006.01) |
| ***E05B 69/00*** | (2006.01) |
| ***E05B 73/00*** | (2006.01) |

(52) U.S. Cl. ..... 40/624; 40/601; 248/329; 248/332; 248/157; 70/101; 70/94; 70/14; 70/158; 70/57; 70/173; 70/58; 472/33

(58) Field of Classification Search ..... 40/624, 40/601; 248/329, 332, 157; 70/101, 94, 70/14, 158–173, 57, 58; 472/33
See application file for complete search history.

(56) References Cited

U.S. PATENT DOCUMENTS

| | | | | |
|---|---|---|---|---|
| 4,829,688 | A * | 5/1989 | Mouraret et al. | 40/622 |
| 7,014,226 | B1 * | 3/2006 | Huang | 292/144 |
| 7,195,294 | B1 * | 3/2007 | White | 292/259 R |
| 7,666,103 | B2 * | 2/2010 | Pondorfer et al. | 472/33 |

* cited by examiner

*Primary Examiner* — Joanne Silbermann
*Assistant Examiner* — Syed A Islam

(57) ABSTRACT

An elevating billboard and control method thereof, which includes a hollow column, a billboard stent, and a windlass controlling a motor, forward relay and back relay, wherein a hollow cylinder is fixed with the billboard stent and rings the column so as to slide along the column up and down, a fixed pulley disposed on the top of the column, a free end of a guy cable of the windlass connecting with the hollow cylinder by the fixed pulley. By using the motor of the windlass and the fixed pulleys, the elevating billboard is easy to assemble, disassemble or maintain, and is capable of completing the up and down movement easily and quickly. And using the real-time monitor of the anemoscope, the elevating billboard completes the up and down movement easily and quickly by wind scale.

10 Claims, 13 Drawing Sheets

ELEVATING BILLBOARD AND CONTROL METHOD THEREOF

BACKGROUND OF THE PRESENT INVENTION

1. Field of Invention

The present invention relates to a billboard and control method thereof, and more particularly to a large elevating billboard and control method thereof, wherein the elevating billboard is easy to assemble, disassemble or maintain.

2. Description of Related Arts

Billboards are used as devices to transmit advertising information to the public, and according to different need, the billboards can be made into various forms. Among that the large billboards which are established on transport corridors, transport hubs and so on are more common, the billboard stent of the billboards are usually supported on single column or multiple columns, and according to the billboard face, the billboards can be divided into single-face, double-face, multiple-face. Because such billboards have simple structure, easy production process and can attract the attention of passers, the billboards are widely used. However, in actual use, it is found that: because the billboard stent is fixed with the column, the workers and the equipments work on a high altitude when the billboards are assembled, disassembled, maintained or replaced in use, clearly on the one hand, this brings a great deal of inconvenience to operation, on the other hand, it brings security risk to the workers. And in windy weather, the billboards which have a high position cannot change their own height with the wind, therefore it is easy to damage the billboards, and even the columns fall in bad weather, which does not only bring unnecessary loss to the advertisers and manufacturers, but also brings great security risk to the pedestrians. In order to eliminate such defect, it is tended to increase the size of the column, improve the material of the billboard stent and so on to meet the wind load in windy weather, however, this program will obviously increase the manufacture cost of the billboards.

For the current situation, someone designs an elevating billboard, such as an elevating billboard, according to Chinese patent, Publication No. CN200969193Y, the elevating billboard comprises at least a pair of main columns, a supporting assembly for fixing the main column, and a pair of telescopic cylinders fixed with the corresponding main column, wherein each telescopic cylinder consists of link antenna-style multistage cylinder, a face is disposed between two corresponding telescopic cylinders. In use, the face is mounted on a lower position through the telescopic cylinders, and then the face is risen to a high position in order to overcome the danger of working on a height and the inconvenience of assembly and disassembly. However, in actual operation, after the face is mounted on the top telescopic cylinder, it is needed to draw out the top telescopic cylinder from the lower telescopic cylinder. Apparently, it is laborious and time-consuming to complete this operation, especially, when such operation is used in large billboard, it is extremely difficult to complete the operation by manual work, and it is slow to complete the up and down movement of the billboards by manual assembly and disassembly, which does not make rapid response in time by wind scale, so this kind of billboards needs to be further improved.

SUMMARY OF THE PRESENT INVENTION

A main object of the present invention is to provide an elevating billboard, which is easy to assemble, disassemble or maintain, and is capable of completing the up and down movement easily and quickly.

Another object of the present invention is to provide a control method of the elevating billboard, which is capable of completing the up and down movement easily and quickly.

Another object of the present invention is to provide a control method of the elevating billboard, which is capable of completing the up and down movement easily and quickly by wind scale.

Accordingly, in order to accomplish the above object, the present invention provides an elevating billboard, comprising:

a hollow column and a billboard stent;

a windlass comprising:

a motor, a forward relay controlling the motor to rotate forward and a backward relay controlling the motor to rotate backward;

a hollow cylinder fixed with the billboard stent and ringing the column so as to slide along the column up and down; and a fixed pulley disposed on a top of the column, wherein a free end of a guy cable on said windlass connecting with said hollow cylinder via said fixed pulley.

According to a preferred embodiment of the present invention, a plurality of roller wheels are disposed on the hollow cylinder and are capable of rolling on an outside wall of the column to avoid impact, so as to make the hollow cylinder move smoothly.

According to an alternative embodiment of the present invention, a guide assembly is disposed between the hollow cylinder and the column. The guide assembly comprises a guide rail axially disposed on the outside wall of the column, and two guide wheels disposed on the hollow cylinder, wherein a guide groove matching with the guide rail is formed between the two guide wheels. The guide plates can replace the guide wheels so as to provide a better guide function in the movement of the hollow cylinder.

In the above embodiment, a locking assembly is disposed between the hollow cylinder and the column, the locking assembly comprises two locating pieces respectively having a keyhole and fixed on the outside wall of the column, a locking pin, an electromagnetic driver, and a spring making the locking pin respectively insert into the keyhole, wherein a sliding path is formed between the two locating pieces, a lockplate is axially disposed on an inside wall of the hollow cylinder and is capable of inserting into the sliding path, the lockplate has an axial slotted hole corresponding to the keyhole, a head of the locking pin corresponds to the keyhole and a tail of the locking pin contacts with the spring, when the electromagnetic driver loses power, the locking pin inserts into the keyholes of the locating pieces, when the electromagnetic driver gets power, the locking pin disengages from the sliding path.

As an alternative embodiment, the locking pin is driven by a connecting rod, the locking assembly comprises two locating pieces respectively having a keyhole and fixed on the outside wall the column, a fixed shaft, a locking pin, an electromagnetic driver, a spring, a first connecting rod and a second connecting rod, wherein a sliding path is formed between the two locating pieces, a lockplate is axially disposed on the inside wall of the hollow cylinder and is capable of inserting into the sliding path, the lockplate has an axial slotted hole corresponding to the keyhole, the head of the locking pin corresponds to the keyhole and the tail of the locking pin connects with one end of the first connecting rod by a hinge, another end of the first connecting rod connects with one end of the second connecting rod by a hinge, another end of the second connecting rod rotationally connects with the fixed shaft, two ends of the spring respectively connect with a middle of the first connecting rod and a middle of the second connecting rod, another end of the second connecting rod also connects with a slide rod which is controlled by the electromagnetic driver and the spring, when the electromagnetic driver loses power, the locking pin inserts into the keyholes of the locating pieces, when the electromagnetic driver gets power, the locking pin disengages from the sliding path.

As an alternative embodiment, the locking pin is driven by rotational manner, namely, the locking assembly comprises two locating pieces fixed on the outside wall of the column, a fixed shaft, a locking pin, an electromagnetic driver, a spring and a connecting rod, wherein a sliding path is formed between the two locating pieces, a locating groove is formed on a top of the locating piece, a lockplate is axially disposed on the inside wall of the hollow cylinder and is capable of inserting into the sliding path, an axial elongated groove corresponding to the locating groove is formed on a bottom of the lockplate, one end of the locking pin is fixed with the connecting rod, one end of the locking pin and the connecting rod together connect with the fixed shaft, another end of the connecting rod connects with the slide rod controlled by the electromagnetic driver and the spring, when the electromagnetic driver loses power, the locking pin rotates to the locating grooves of the locating pieces, when the electromagnetic driver gets power, the locking pin deviates from the sliding path. After using the above locking assembly, when the billboard stent is positioned on the top of the column, the weight of the billboard stent is borne by the guy cable so as to increase the service life and the working reliability.

As an useful embodiment, a first trigger switch is disposed on an outside wall of a lower end of the column and is capable of controlling the motor to stall while the hollow cylinder is falling, a third trigger switch is disposed on an upper end of the column, while the hollow cylinder is falling, the third trigger switch is capable of controlling the motor to stall and controlling the electromagnetic driver to lose power at the same time. The motor of the windlass is accurately controlled by the corresponding trigger switch. In order to reduce the access time of the electromagnetic driver, a second trigger switch is fixed on the outside wall of the column and is positioned lower than the locating piece, while the hollow cylinder is rising, the second trigger switch is capable of controlling the electromagnetic driver to get power. When the hollow cylinder get close to the locking assembly, the electromagnetic gets power to drive the locking pin to deviate from the sliding path so as to put the lockplate in the sliding path.

The elevating billboard further comprises an anemoscope, a control assembly, wherein the control assembly controls the windlass and the electromagnetic driver with a wind speed signal, a control signal of the first trigger switch, a control signal of the second trigger switch and a control signal of the third trigger switch. The control assembly controls the windlass and the electromagnetic driver with the wind speed signal, the control signal of the first trigger switch, the control signal of the second trigger switch and the control signal of the third trigger switch, the wind speed signal is measured with the anemoscope, so as to avoid damaging the elevating billboard by wind; the electromagnetic driver is controlled by using the control signal of the second trigger switch so as to reduce the access time of the electromagnetic.

As an improvement, the control assembly comprises a control element, a signal conversion element, a fourth trigger switch controlling the billboard stent to rise, a fifth trigger switch controlling the billboard stent to fall, and an AND gate chip, wherein the first trigger switch and the fourth trigger switch respectively connect with two input port of the AND gate chip, an output port of the AND gate chip connects with a first signal input port of the control element, the second trigger switch connects with a second signal input port of the control element, the third trigger switch connects with a third signal input port of the control element, the fifth trigger switch connects with a fourth signal input port of the control element, the anemoscope connects with a fifth signal input port of the control element by the signal conversion element, the first trigger switch connects with a sixth signal input port of the control element, a first signal output port of the control element connects with the electromagnetic driver, a second signal output port of the control element connects with the forward relay of the windlass, a third signal output port of the control element connects with the backward relay of the windlass.

A power fixed contact is disposed on the upper end of the column, and a power movable contact which separably contacts with the power fixed contact is fixed on the hollow cylinder, such that the elevating billboard can get power in general condition.

In order to accomplish the above object, the present invention provides a control method of the elevating billboard, comprising the steps of:

(1) predetermining a secure wind speed, a first delay time, a second delay time in the control assembly;

(2) judging whether a signal of the first input port of the control element is true, namely, judging whether the fourth trigger switch controlling the billboard stent to rise and the first trigger switch controlling the windlass to stall start at the same time; if yes, an output control signal of the control element makes the forward relay get power and makes the backward relay lose power, entering the rising process of the billboard stent; if not, entering the next step;

(3) judging whether a signal of the fifth input port of the control element is true, namely, judging whether the fifth trigger switch has started; if yes, the output control signal of the control element makes the forward relay get power and makes the backward relay lose power, entering the falling process of the billboard stent; if not, returning to the step (2)

In the step (2), the rising process of the billboard stent comprises the following steps of:

(21) judging whether a signal of the second input port of the control element is true, namely, judging whether the second trigger switch has started, if not, returning to the step (21); if yes, the output control signal of the control element makes the electromagnetic driver get power;

(22) judging whether a signal of the third input port of the control element is true, namely, judging whether the third trigger switch has started, if not, returning to the step (22); if yes, the output control signal of the control element makes the electromagnetic driver lose power and makes the forward relay lose power;

(23) the output control signal of the control element makes the backward relay get power, then the billboard stent begins to fall;

(24) after the predetermined first delay time, the output control signal of the control element makes the backward relay lose power;

In the step (3), the falling process of the billboard stent comprises the following steps of:

(31) judging whether the signal of the third input port of the control element is true, namely, judging whether the third trigger switch has started, if not, returning to the step (31); if yes, the output control signal of the control element makes the electromagnetic driver get power so as to make the forward relay of the windlass lose power;

(32) the output control signal of the control element makes the backward relay of the windlass get power;

(33) judging whether the signal of the second input port of the control element is true, namely, judging whether the second trigger switch has started, if not, returning to the step (32); if yes, the output control signal of the control element makes the electromagnetic driver lose power;

(34) judging whether a signal of the sixth input port of the control element is true, namely, judging whether the first trigger switch has started, if not, returning to the step (34); if yes, the output control signal of the control element makes the backward relay of the windlass lose power;

According to the preferred embodiment of the present invention, the rising process of the billboard stent further comprises the following step of: (25) the control element reads a wind speed signal of the fifth input port, judging whether wind speed is greater than or equal to the secure wind speed, if not, returning to the step (25); if yes, entering the falling process of the billboard stent.

The falling process of the billboard stent further comprises the following step of:

(35) the control element reads a first wind speed of the fifth input port, judging whether the first wind speed is less than the secure wind speed, if not, returning to the step (35); if yes, turning on a timer which is predetermined with the second delay time, and entering the next step;

(36) the control element reads a second wind speed of the fifth input port, judging whether the second wind speed is less than the secure wind speed, if not, returning to the step (35); if yes, entering the next step;

(37) judging whether the timer has expired, if yes, entering the rising process of the billboard stent; if not, returning to the step (36).

Comparing with the related arts, the invention can make the billboard stent rise or fall by using the motor of the windlass and the fixed pulley, so in assembly, disassembly, maintenance or replacement of the elevating billboard, the windlass is started to make the billboard stent fall, so that it does not only reduce the assembly cost and maintenance cost, but also increases the work security and makes the operation easy, convenient and fast. In addition, through real-time monitor of the anemoscope, once the measuring wind speed is greater than the design requirement of the elevating billboard, the billboard stent falls automatically to avoid the damage, so the elevating billboard is easy to control and operate, such that the elevating billboard has better practical value.

These and other objectives, features, and advantages of the present invention will become apparent from the following detailed description, the accompanying drawings, and the appended claims.

DETAILED DESCRIPTION OF THE PREFERRED EMBODIMENT

Figure 1:
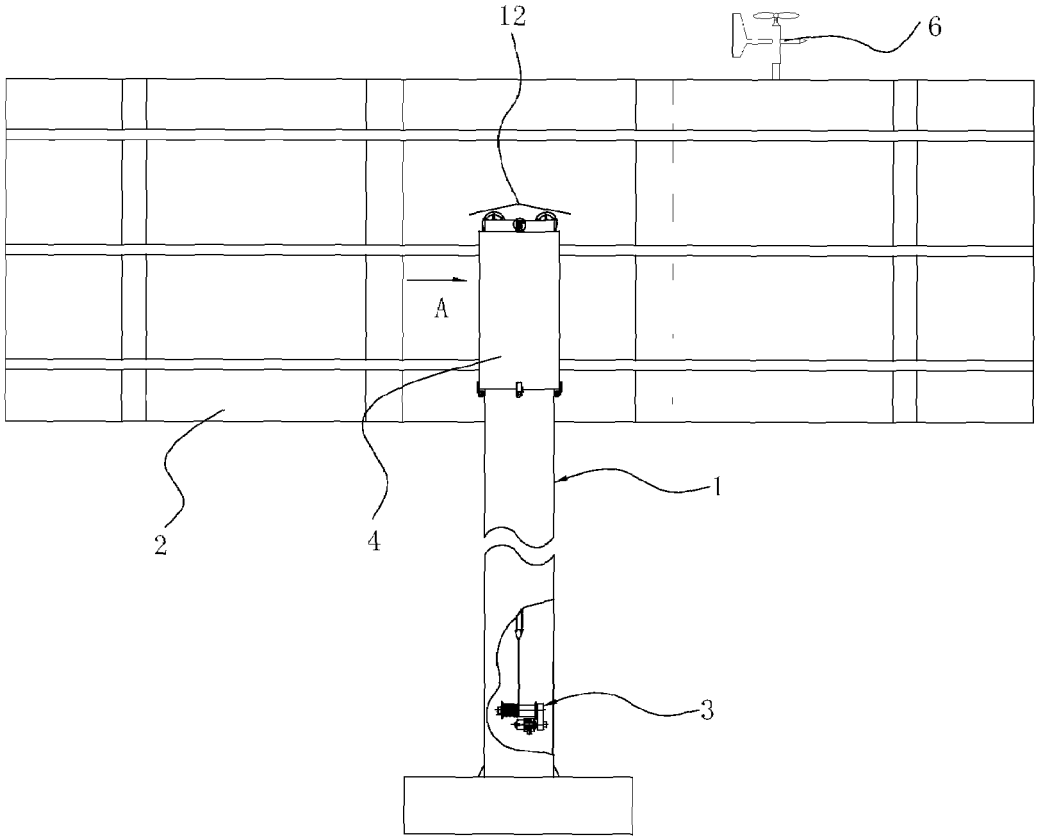
FIG. 1 is a structural schematic view of an elevating billboard according to a preferred embodiment of the present invention.
Figure 2:
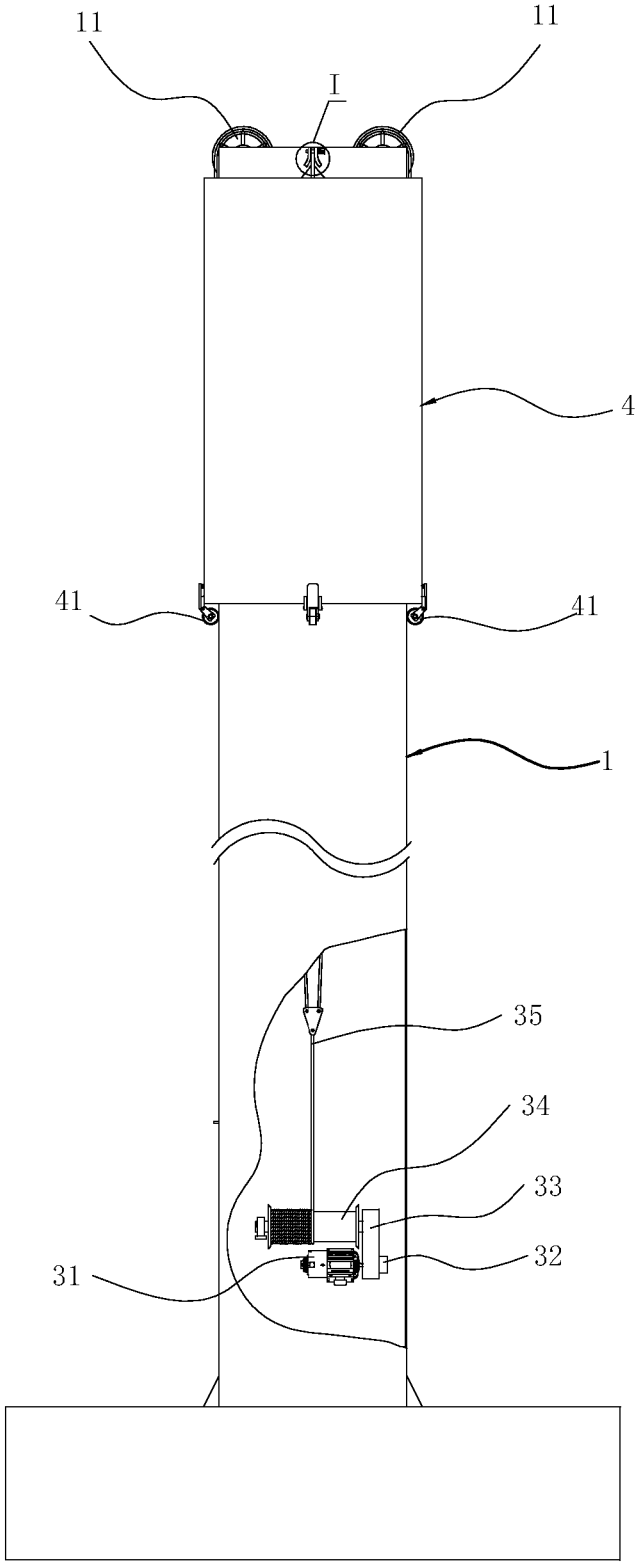
FIG. 2 is a structural schematic view of an elevating billboard without the billboard stent according to the above preferred embodiment of the present invention.
Figure 3:
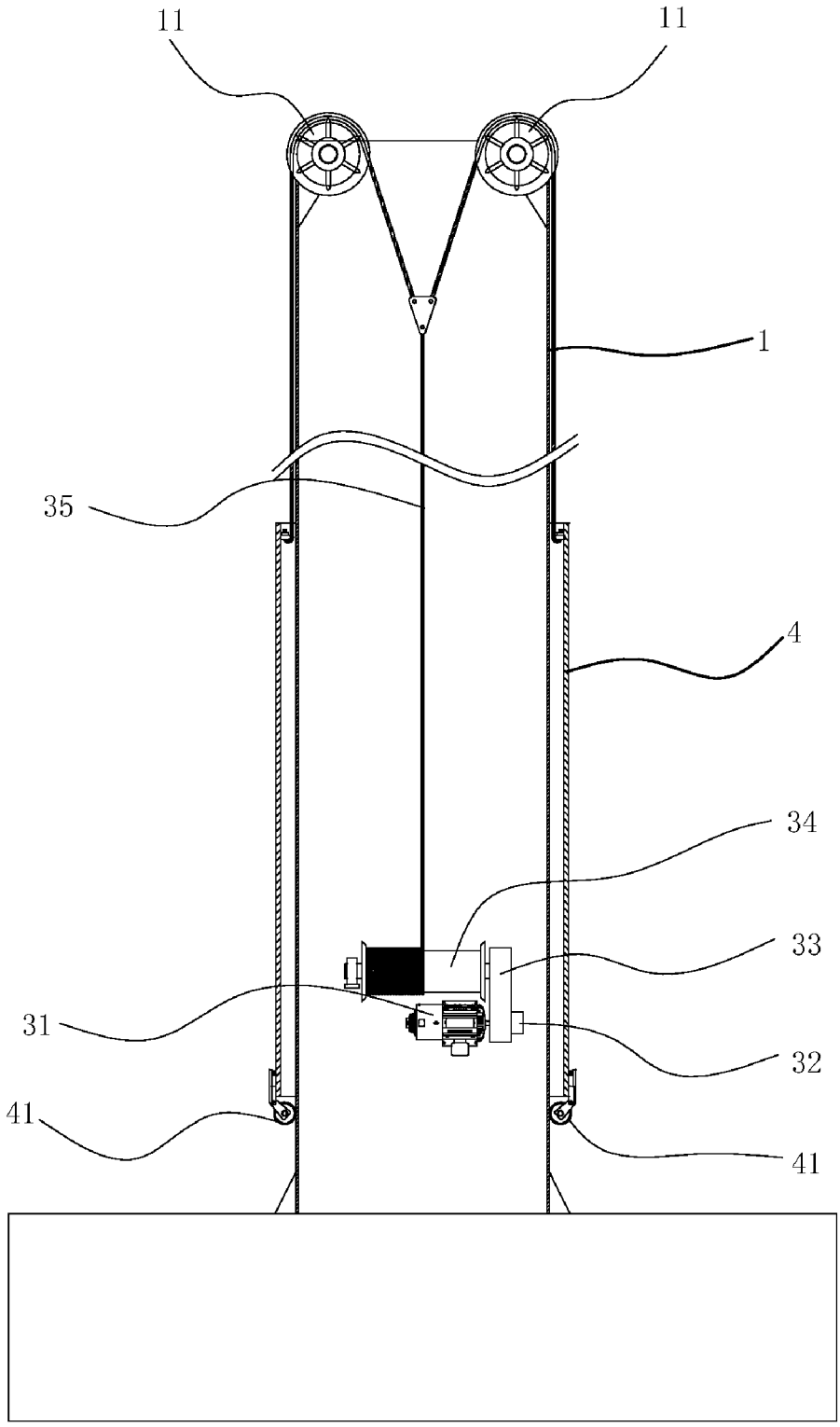
FIG. 3 is a structural schematic view of an elevating billboard without the billboard stent when the hollow cylinder has fallen, according to the above preferred embodiment of the present invention.
Figure 4:
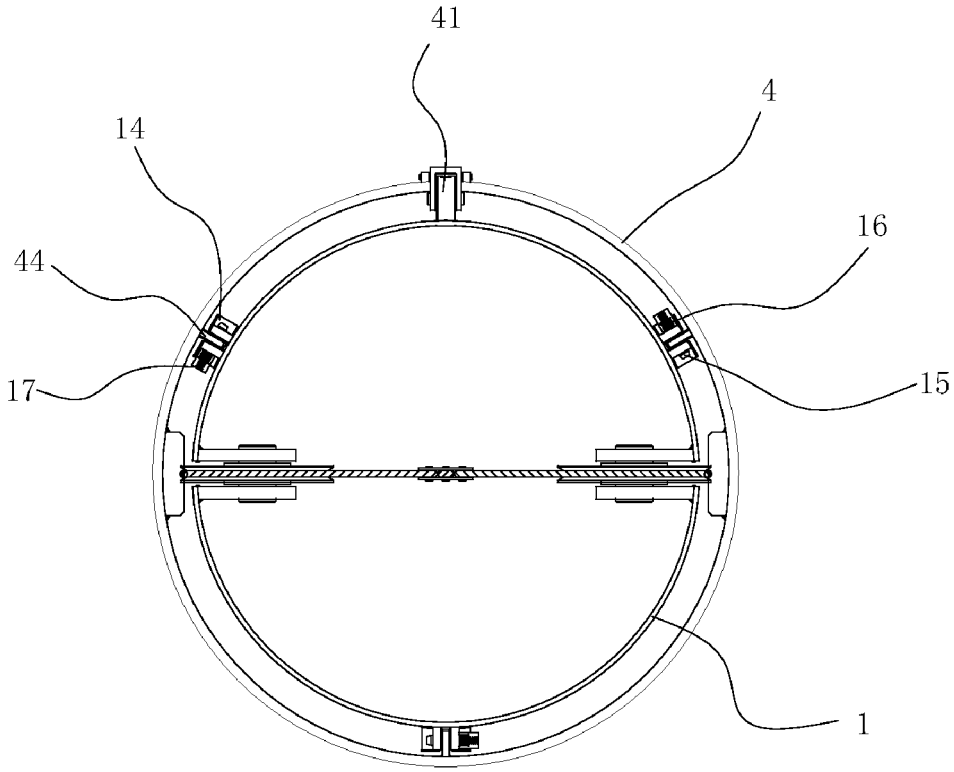
FIG. 4 is a top view of FIG. 2.

Further detailed description of the invention is made with reference to the drawings.

Referring to FIG. 1 to FIG. 4 of the drawings, an elevating billboard comprises a column 1, a billboard stent 2, a windlass 3, a hollow cylinder 4, at least a locking assembly and an anemoscope 6, wherein, the column 1 uses a hollow tubular body, a bottom of the column 1 is based on the ground by foundation as usual, and a lower end of the column 1 has an opening in order to install the equipment in the column 1; two fixed pulleys 11 are symmetrically disposed on a top of the column 1. The windlass 3 uses conventional structure, which consists of a motor 31, a coupling, an arresting gear 32, a decelerator 33, a guy cable 35 coiling around a drum 34, a forward relay controlling the motor 31 to rotate forward and a backward relay controlling the motor 31 to rotate backward. According to a preferred embodiment of the present invention, the windlass 3 is disposed within the column 1 and is fixed on an inside wall of the lower end of the column 1, of course, the windlass 3 may also be fixed on the foundation in the column 1 or be fixed on the ground outside the column 1, under the circumstances, a guide fixed pulley 11 is disposed on the opening, the guy cable 35 of the windlass 3 comes into the column 1 via the guide fixed pulley 11. An umbelliform cap 12 is disposed on the top of the column 1 in order to avoid exposing the windlass 3 to the sun and rain.

Figure 5:
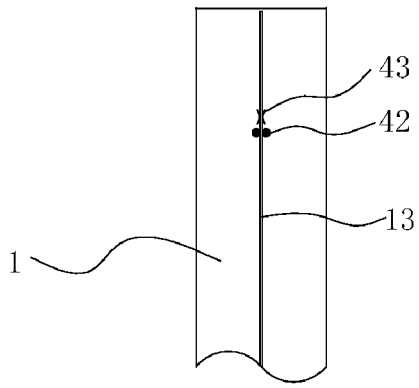
FIG. 5 is a structural schematic view of the guide assembly positioned between the column and the hollow cylinder according to the above preferred embodiment of the present invention.
Figure 6:
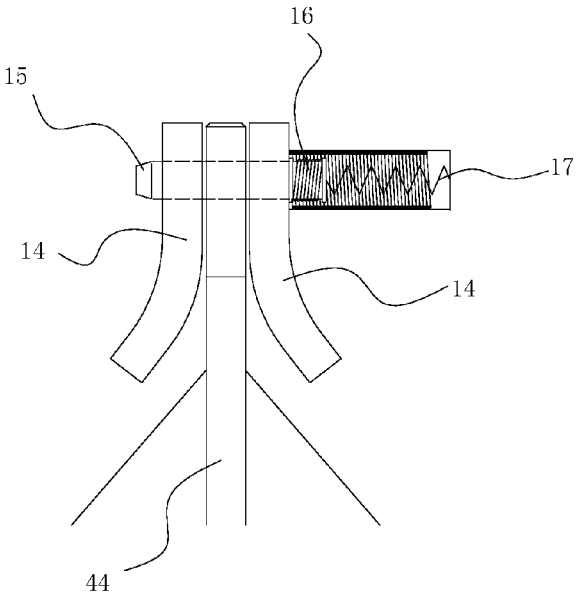
FIG. 6 is an amplificatory schematic view of the part I of FIG. 2.
Figure 7:
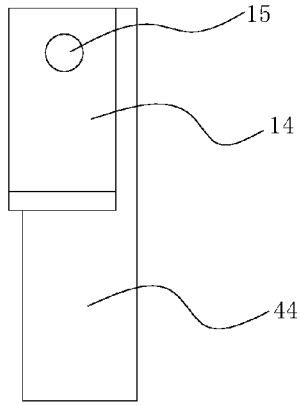
FIG. 7 is a side view of FIG. 6.

The billboard stent 2 uses conventional structure which may be symmetrical or eccentric. The elevating billboard can be double-faced or three-faced, according to the preferred embodiment of the present invention, the elevating billboard is single-faced, the billboard stent 2 is fixed with the hollow cylinder 4, the hollow cylinder 4 rings the column 1, a free end of the guy cable 35 is divided into two strands through a connector, the two strands respectively connect with an upper end of the hollow cylinder 4 through the corresponding fixed pulley 11. With the operation of the motor 31, the guy cable 35 drives the hollow cylinder 4 to make the hollow cylinder 4 slide along an outside wall of the column 1. In order to make the hollow cylinder 4 move more smoothly, four roller wheels 41 are disposed on a lower end of the hollow cylinder 4 and is capable of rolling on the outside wall of the column 1. A guide assembly is disposed between the hollow cylinder 4 and the column 1, here, the guide assembly consists of a guide rail 13 axially disposed on the outside wall of the column 1, and two guide wheels 42 disposed on the inside wall of the hollow cylinder 4, as shown in FIG. 5, wherein a guide groove matching with the guide rail 13 is formed between two guide wheels 42. Of course, the guide groove can also be formed between two guide plates 43 which are fixed on an inside wall of the hollow cylinder 4. Such structure not only avoids the collision between the hollow cylinder 4 and the column 1, but also ensures that the hollow cylinder 4 does not rotate with respect to the column 1 in windy weather or under external force so as to make the elevating billboard operate more steadily.

Figure 8:
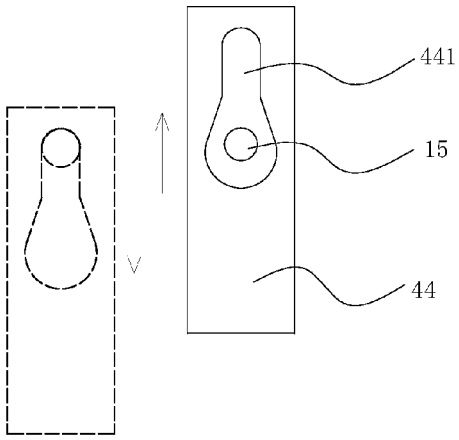
FIG. 8 is a structural schematic view of the lockplate of FIG. 7.
Figure 9:
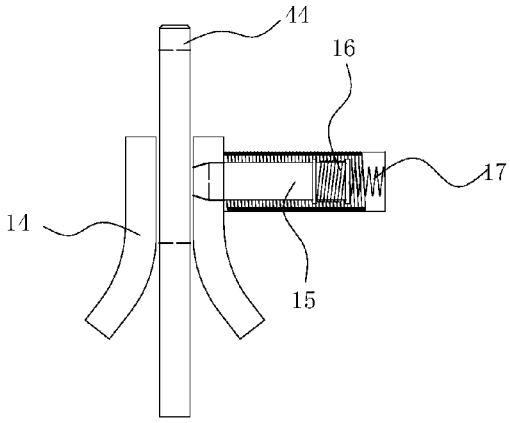
FIG. 9 is a structural schematic view of the locking assembly of the FIG. 6 in free condition.

When the billboard stent 2 is positioned on the top of the column 1, the guy cable 35 is braked by the arresting gear 32 of the windlass 3, such that the weight of the billboard stent 2 is borne by the guy cable 35, but considering about the service life and the working reliability of the guy cable 35, according to the preferred embodiment of the present invention, the elevating billboard further comprises three locking assemblies, each locking assembly comprises two locating pieces 14 respectively having a keyhole and fixed on the outside wall the column 1, a locking pin 15, an electromagnetic driver 16, and a spring 17 making the locking pin 15 respectively insert into the keyhole, as shown in FIG. 2, FIG. 6 to FIG. 9, wherein a sliding path is formed between the two locating pieces 14, a lockplate 44 is axially disposed on the inside wall of the hollow cylinder 4 and is capable of inserting into the sliding path, the lockplate 44 has an axial slotted hole 441 corresponding to the keyhole, a head of the locking pin 15 corresponds to the keyhole and a tail of the locking pin 15 contacts with the spring 17. In use, when the lower half of the slotted hole 441 corresponds to two sides of the keyhole, the electromagnetic driver 16 releases the locking pin 15 after the electromagnetic driver 16 loses power, then under the force of the spring 17, the locking pin 15 transversely traverses the keyholes and the slotted hole 441 positioned between the two keyholes. And controlling the motor 31 of the windlass 3 backward to make the hollow cylinder 4 fall off a short distance so as to unload the load of the guy cable 35, at this point, the locking pin 15 contacts with an upper edge of the slotted hole 441, so that the weight of the billboard stent 2 entirely falls on the locking pin 15, as shown in FIG. 8. Once the billboard stent 2 is needed to fall, by making the billboard stent 2 rise up a short distance to unload the load of the locking pin 15, and making the electromagnetic driver 16 get power, the locking pin 15 retracts under the force of the magnetic attraction and disengages from the sliding path, such that the hollow cylinder 4 is capable of moving freely, as shown in FIG. 9.

Figure 10:
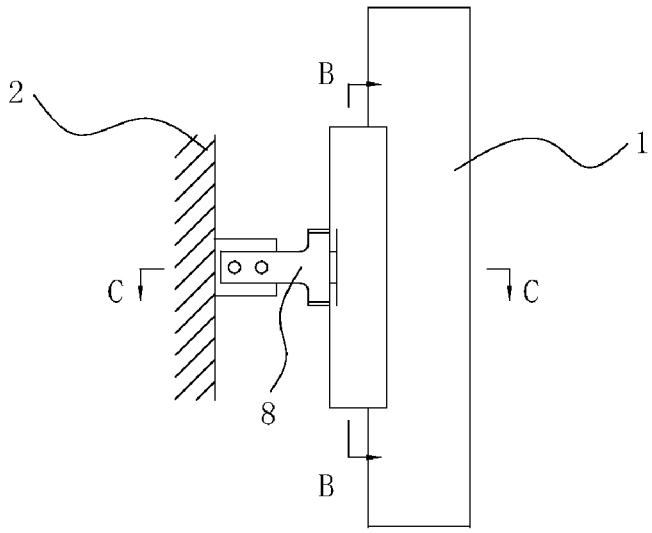
FIG. 10 is a structural schematic view of A direction of FIG. 6.
Figure 11:
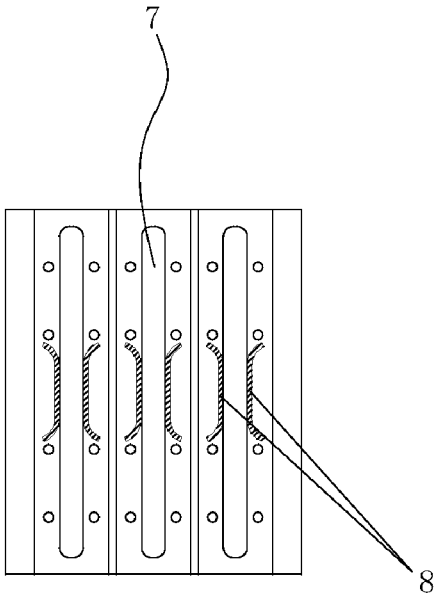
FIG. 11 is a structural schematic view of B-B direction of FIG. 10.
Figure 12:
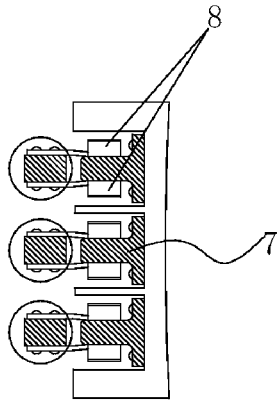
FIG. 12 is a structural schematic view of C-C direction of FIG. 10.

In order to ensure the access of power reliable between the billboard stent 2 and the column 1, a power fixed contact 7 is disposed on an upper end of the column 1, and a power movable contact 8 which separably contacts with the power fixed contact 7 is fixed on a top of the hollow cylinder 4. As shown in FIG. 10 to FIG. 12, the power fixed contact 7 and the power movable contact 8 respectively connect with corresponding wires, when the hollow rises to the top of the column 1, the power fixed contact 7 contacts with the power movable contact 8, so that the power is on between the billboard stent 2 and the column 1 so as to provide normal illumination for the elevating billboard.

Figure 13:
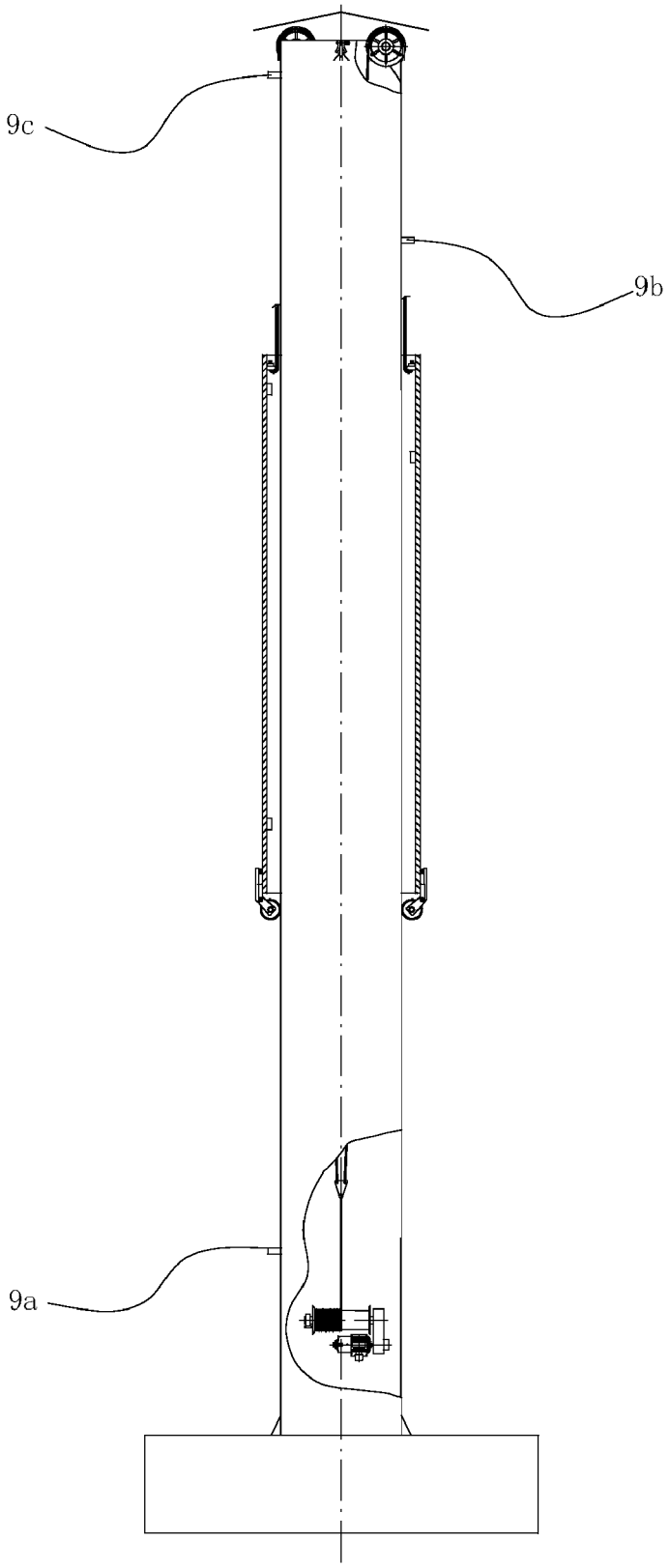
FIG. 13 is a position view of three limit switches mounted on the outside wall of the hollow cylinder according to the above preferred embodiment of the present invention.
Figure 14:
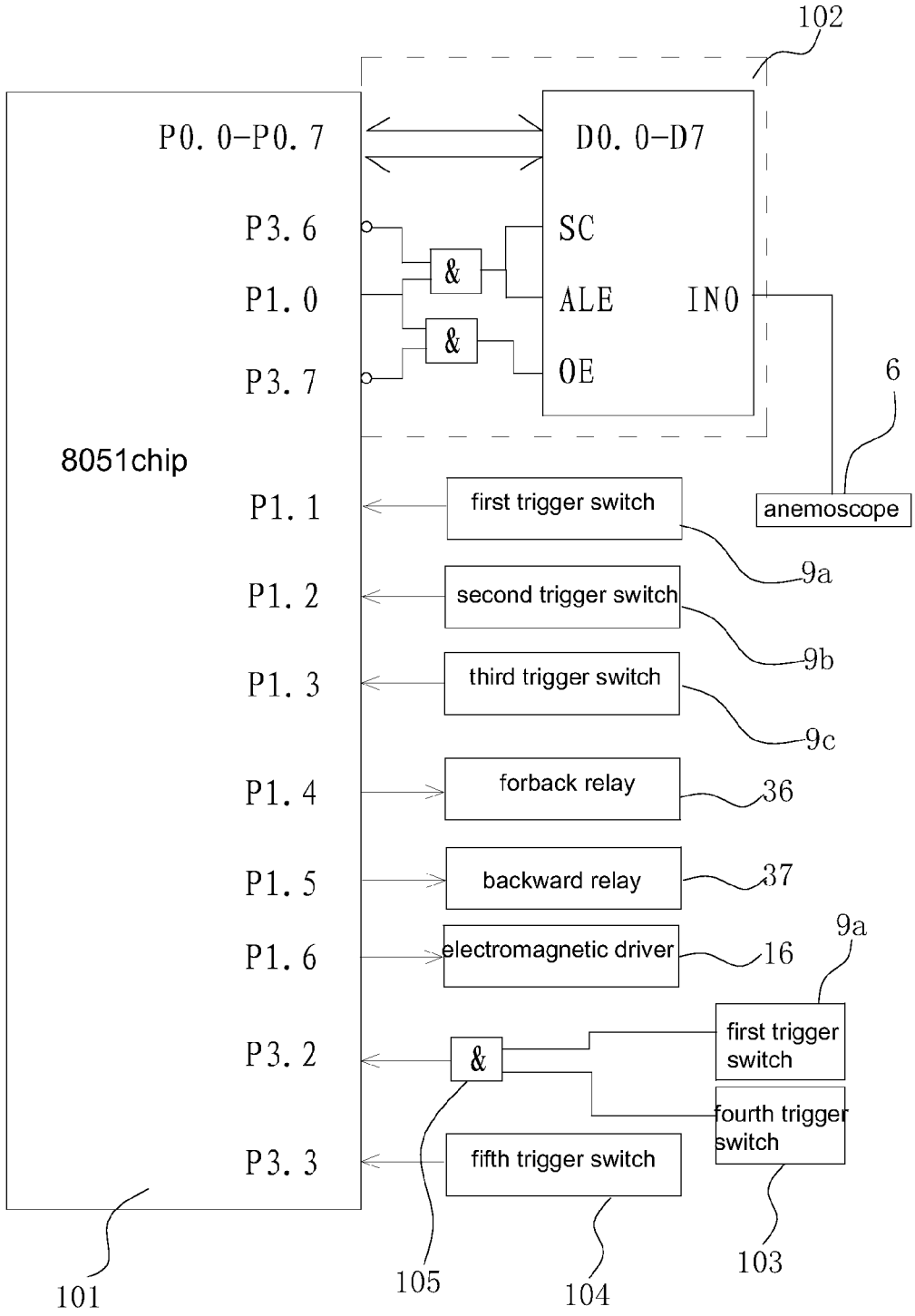
FIG. 14 is a circuit logic diagram of the control assembly according to the above preferred embodiment of the present invention.

In the rising or falling process of the hollow cylinder 4, stalling of the motor 31 may be controlled by a time relay, but in order to control more accurately, a first trigger switch **9*a* is disposed on an outside wall of the lower end of the column 1 and is capable of controlling the motor 31 to stall while the hollow cylinder 4 is falling, a third trigger switch 9*c* is disposed on the upper end of the column 1, while the hollow cylinder 4 is falling, the third trigger switch 9*c* is capable of controlling the motor 31 to stall and controlling the electromagnetic driver 16 to lose power at the same time. And in order to save energy, a second trigger switch 9*b* is fixed on the outside wall of the column 1 and is positioned lower than the locating piece 14, while the hollow cylinder 4 is rising, the second trigger switch 9*b* is capable of controlling the electromagnetic driver 16 to get power, as shown in FIG. 13. Each trigger switch consists of a block mounted on the hollow cylinder 4, and a limit switch positioned on the column 1**, wherein the limit switch may be contact switch, such as travel switch which sends signal while the block contacts with the mechanical contact of the travel switch. The limit switch may also be non-contact switch, such as dry-reed switch, photoelectric switch, and inductive switch.

Considering the windy weather, the billboard stent 2 is capable of falling automatically, according to the preferred embodiment of the present invention, the anemoscope 6 is disposed on the billboard stent 2, the elevating billboard further comprises a control assembly, wherein the control assembly controls the windlass 3 and the electromagnetic driver 16 with a wind speed signal, a control signal of the first trigger switch **9*a*, a control signal of the second trigger switch 9*b* and a control signal of the third trigger switch 9*c*, the wind speed signal is measured by the anemoscope 6. The control assembly may be disposed in the column 1, may also be disposed on the ground. The anemoscope 6 monitors a real-time wind speed and sends the real-time wind speed to the control assembly, the control assembly controls the rising or falling operation of the hollow cylinder 4 with the wind speed signal, the control signal of the first trigger switch 9*a*, the control signal of the second trigger switch 9*b* and the control signal of the third trigger switch 9*c*, so as to avoid damaging the elevating billboard by wind. The control assembly controls the electromagnetic driver 16 to get or lose power by using the control signal of the second trigger switch 9*b* so as to reduce the access time of the electromagnetic driver 16**.

Here, the control assembly comprises a control element 101, a signal conversion element 102, a fourth trigger switch 103 controlling the billboard stent 2 to rise, a fifth trigger switch 104 controlling the billboard stent 2 to fall, and an AND gate chip 105, the first trigger switch **9*a* and the fourth trigger switch 103 respectively connect with two input ports of the AND gate chip 105, an output port of the AND gate chip 105 connects with a first signal input port of the control element 101, the second trigger switch 9*b* connects with a second signal input port of the control element 101, the third trigger switch 9*c* connects with a third signal input port of the control element 101, the fifth trigger switch 104 connects with a fourth signal input port of the control element 101, the anemoscope 6 connects with a fifth signal input port of the control element 101 via the signal conversion element 102, the first trigger switch 9***a* connects with a sixth signal input port of the control element 101, a first signal output port of the control element 101 connects with the electromagnetic driver 16, a second signal output port of the control element 101 connects with the forward relay of the windlass 3, a third signal output port of the control element 101 connects with the backward relay of the windlass 3.

According to the preferred embodiment of the present invention, the control element 101 is a microprocessor chip NO. 8051, the P3.2 pin of the microprocessor chip connects with the output port of the AND gate chip 105 as the first signal input port, the P1.2 pin of microprocessor chip connects with the second trigger switch 9*b* as the second signal input port, the P1.3 pin of microprocessor chip connects with the third trigger switch 9*c* as the third signal input port, the P3.3 pin of microprocessor chip connects with the fifth trigger switch 104 as the fourth signal input port, the P0.0-P0.7, P3.6, P1.0, P3.7 pin of the microprocessor chip connect with the signal conversion element 102 as the fifth signal input port, the P1.1 pin of microprocessor chip connects with the first trigger switch 9*a* as the sixth signal input port, the P1.6 pin of microprocessor chip connects with the electromagnetic driver 16 as the first signal output port, the P1.4 pin of microprocessor chip connects with the forward relay as the second signal output port, the P1.5 pin of microprocessor chip connects with the backward relay as the third signal output port.

The signal conversion element 102 uses conventional technology, consists of a convertor NO. ADC0809, a first inverter, a second inverter, a first AND gate chip 105, and a second AND gate chip 105, wherein the anemoscope 6 connects with the INO input pin of the convertor, the D0.0-D0.7 pin of the convertor respectively connect with the P0.0-P0.7 pin of the microprocessor chip, the P3.6 pin of microprocessor chip connects with one input port of the first AND gate chip 105 through the first inverter, the P1.0 pin of microprocessor chip connects with another input port of the first AND gate chip 105, the output port of the first AND gate chip 105 connects with the SC, ALE pin of the convertor, the P3.7 pin of microprocessor chip connects with one input port of the second AND gate chip 105 through the second inverter, the P1.0 pin of microprocessor chip connects with another input port of the second AND gate chip 105, an output port of the second AND gate chip 105 connects with the OE pin of the convertor.

Figure 15:
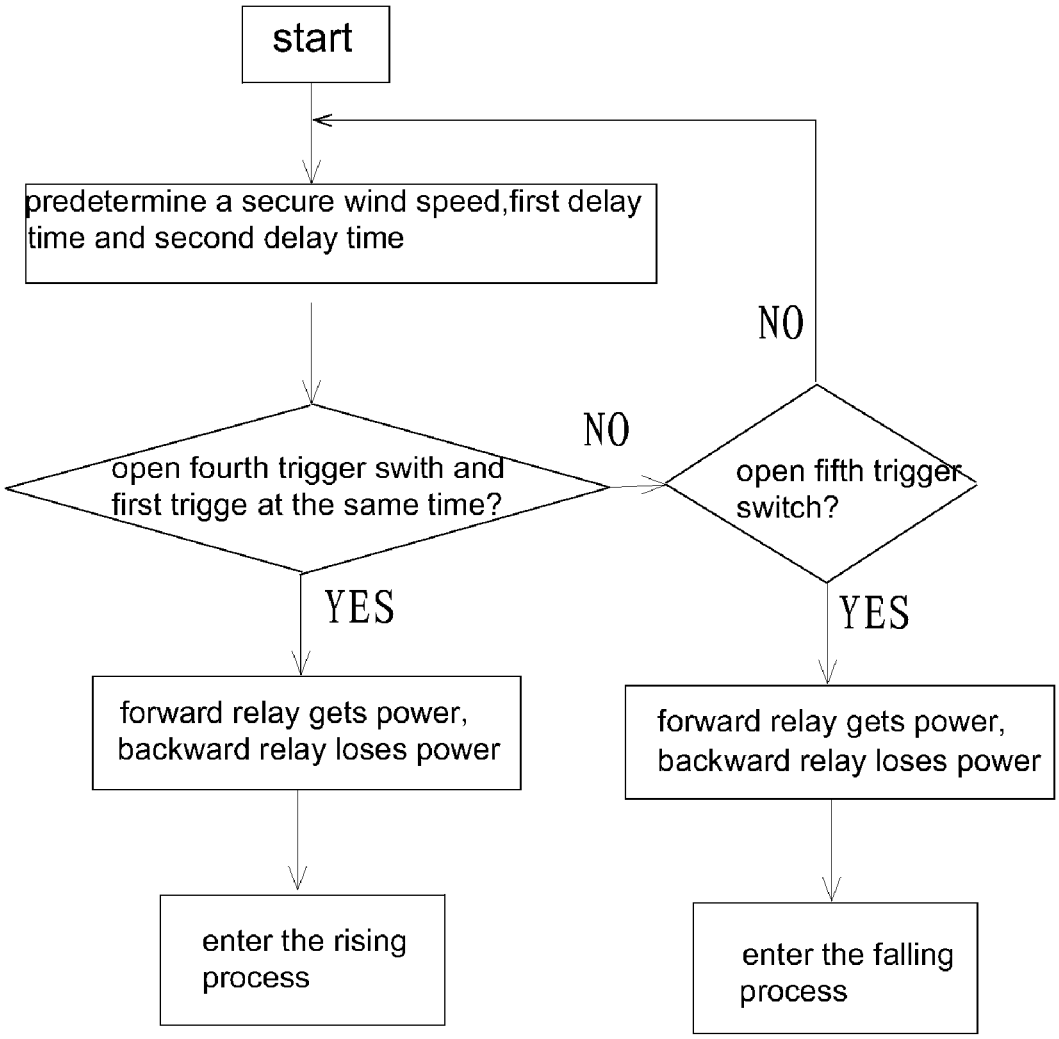
FIG. 15 is a flow chart of a control method according to the above preferred embodiment of the present invention.

As shown in FIG. 15, the control method of the elevating billboard comprises the follow steps of:

(1) predetermining a secure wind speed, a first delay time, a second delay time in the control assembly 10;

(2) judging whether a signal of the first input port of the control element 101 is true, namely, judging whether the fourth trigger switch 103 controlling the billboard stent 2 to rise and the first trigger switch 9*a* controlling the windlass 3 to stall start at the same time; if yes, an output control signal of the control element 101 makes the forward relay get power and makes the backward relay lose power, entering the rising process of the billboard stent 2; if not, entering the next step;

(3) judging whether a signal of the fifth input port of the control element 101 is true, namely, judging whether the fifth trigger switch 104 has started; if yes, the output control signal of the control element 101 makes the forward relay get power and makes the backward relay lose power, entering the falling process of the billboard stent 2; if not, returning to the step (2).

Figure 16:
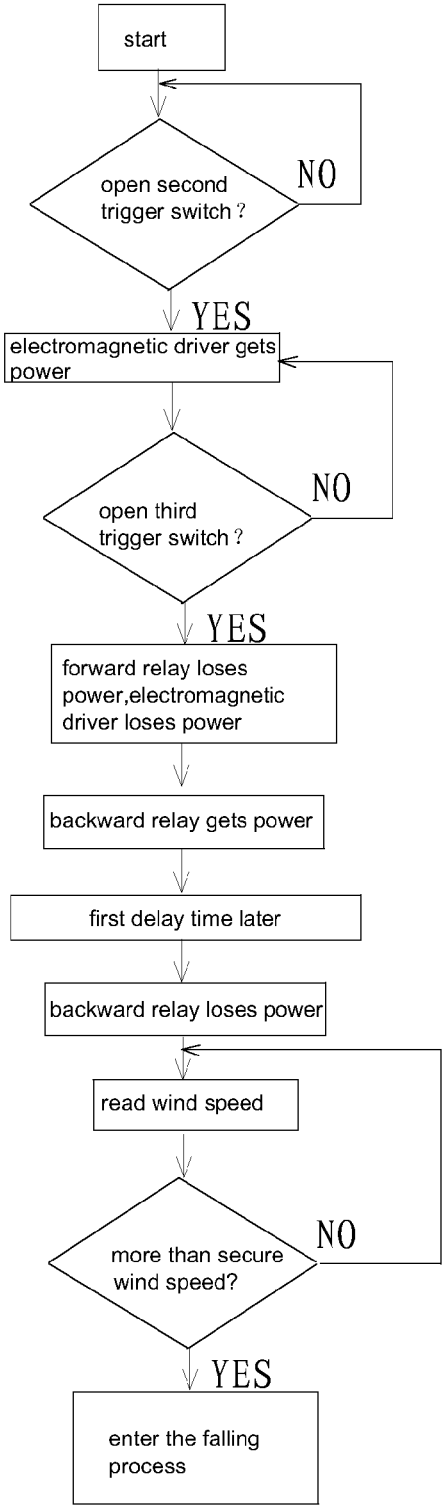
FIG. 16 is a flow chart of the rising process of the billboard stent according to the above preferred embodiment of the present invention.

In the step (2), as shown in FIG. 16, the rising process of the billboard stent 2 comprises the following steps of:

(21) judging whether a signal of the second input port of the control element 101 is true, namely, judging whether the second trigger switch 9*b* has started, if not, returning to the step (21); if yes, the output control signal of the control element 101 makes the electromagnetic driver 16 get power;

(22) judging whether a signal of the third input port of the control element 101 is true, namely, judging whether the third trigger switch 9*c* has started, if not, returning to the step (22); if yes, the output control signal of the control element 101 makes the electromagnetic driver 16 lose power and makes the forward relay lose power;

(23) the output control signal of the control element 101 makes the backward relay get power, then the billboard stent 2 begins to fall;

(24) after the predetermined first delay time, the output control signal of the control element 101 makes the backward relay lose power;

(25) the control element 101 reads a wind speed signal of the fifth input port, judging whether wind speed is greater than or equal to the secure wind speed, if not, returning to the step (25); if yes, entering the falling process of the billboard stent 2.

Figure 18:
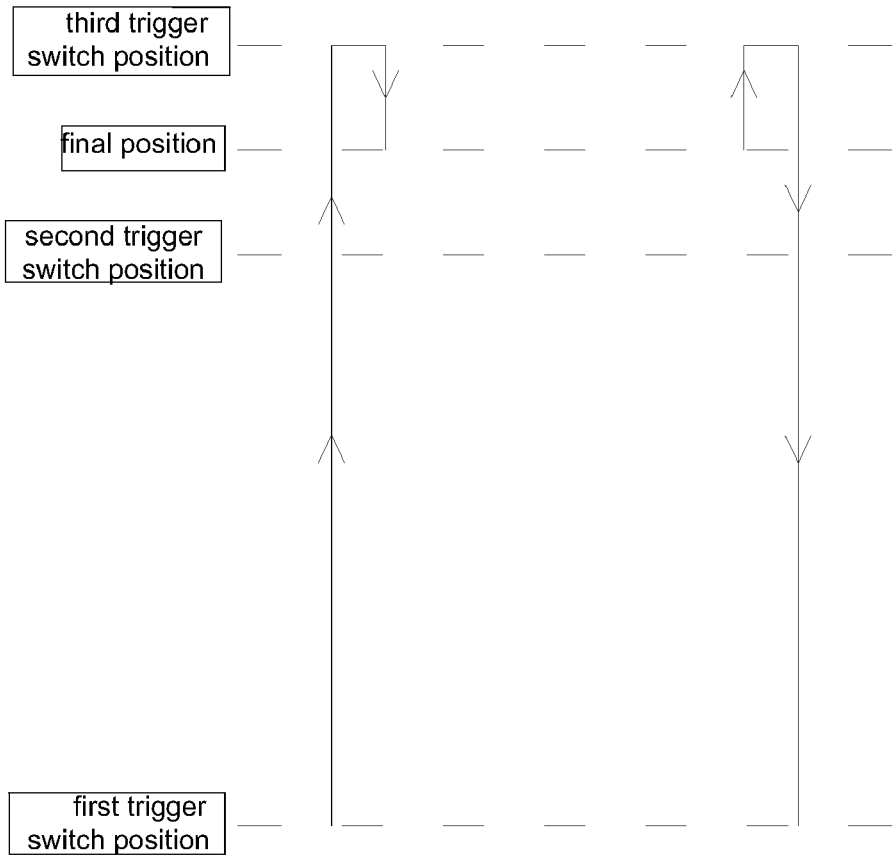
FIG. 18 is a schematic view of the falling and rising process of the hollow cylinder according to the above preferred embodiment of the present invention.

Based on the above method, the rising process of the billboard stent 2 is as follows: as shown in FIG. 18, when the billboard stent 2 is located at the beginning position of the bottom of the column 1, namely, the billboard stent 2 is positioned on the first trigger switch 9*a*, the fourth trigger switch 103 controlling the elevating billboard to rise starts, the motor 31 of the windlass 3 is forward so as to make the guy cable 35 coil around the drum 34, at the same time, via the fixed pulley 11, the guy cable 35 drives the hollow cylinder 4 to slowly and upwards slide along the outside wall of the column 1, when the billboard stent 2 slides to the second limit switch, the second limit switch makes the electromagnetic driver 16 get power, the locking assembly opens, the billboard stent 2 continues to upwards slide, when the billboard stent 2 slides to the third limit switch, the third limit switch makes the windlass 3 lose power, at the same time the electromagnetic driver 16 lose power, the billboard stent 2 stops, the locking assembly closes, and the windlass 3 is backward, after the first delay time, the billboard stent 2 is positioned on a fixed location of the column 1, here, the load of the guy cable 35 is unloaded, the locking pin 15 contacts with the upper edge of the slotted hole 441, so that the weight of the billboard stent 2 entirely falls on the locking pin 15. If the wind speed measured by the anemoscope 6 is greater than or equal to the secure wind speed, entering the falling process of the billboard stent 2.

Figure 17:
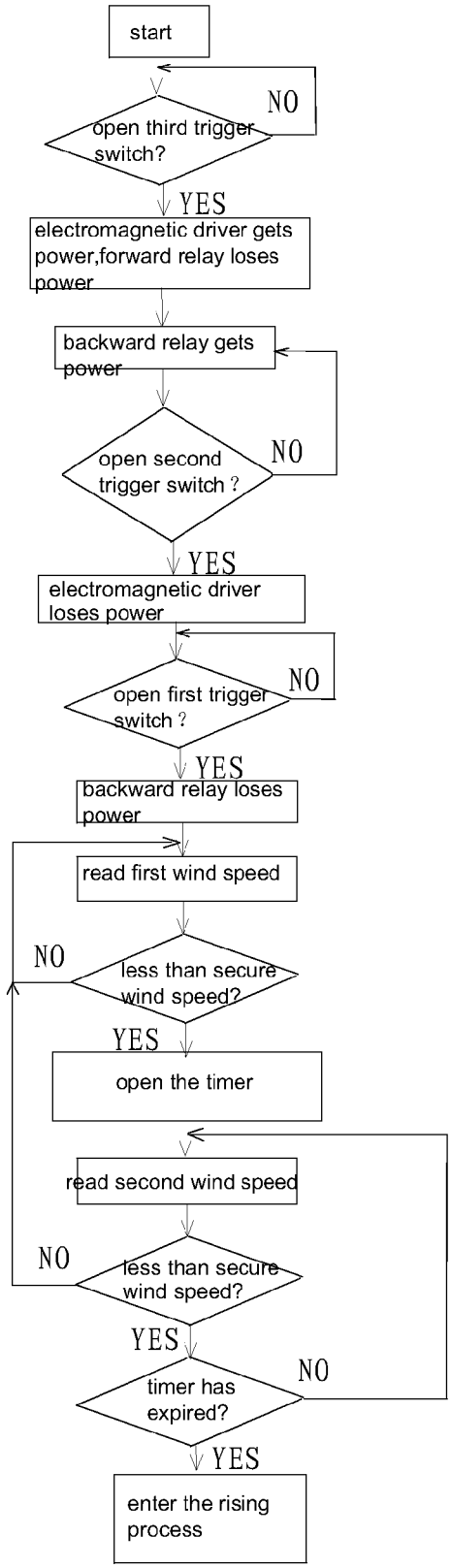
FIG. 17 is a flow chart of the falling process of the billboard stent according to the above preferred embodiment of the present invention.

As shown in FIG. 17, in the step (3), the falling process of the billboard stent 2 comprises the following steps of:

(31) judging whether the signal of the third input port of the control element 101 is true, namely, judging whether the third trigger switch 9*c* has started, if not, returning to the step (31); if yes, the output control signal of the control element 101 makes the electromagnetic driver 16 get power so as to make the forward relay of the windlass 3 lose power;

(32) the output control signal of the control element 101 makes the backward relay of the windlass 3 get power;

(33) judging whether the signal of the second input port of the control element 101 is true, namely, judging whether the second trigger switch 9*b* has started, if not, returning to the step (32); if yes, the output control signal of the control element 101 makes the electromagnetic driver 16 lose power;

(34) judging whether a signal of the sixth input port of the control element 101 is true, namely, judging whether the first trigger switch 9*a* has started, if not, returning to the step (34); if yes, the output control signal of the control element 101 makes the backward relay of the windlass 3 lose power;

(35) the control element 101 reads a first wind speed of the fifth input port, judging whether the first wind speed is less than the secure wind speed, if not, returning to the step (35); if yes, turning on a timer which is predetermined with the second delay time, and entering the next step;

(36) the control element 101 reads a second wind speed of the fifth input port, judging whether the second wind speed is less than the secure wind speed, if not, returning to the step (35); if yes, entering the next step;

(37) judging whether the timer has expired, if yes, entering the rising process of the billboard stent 2; if not, returning to the step (36).

Based on the above methods, the falling process of the billboard stent 2 is as follows: as shown in FIG. 18, when the billboard stent 2 is located at a fixed position of the upper end of the column 1, the fifth trigger switch 104 controlling the billboard stent 2 to fall starts, the motor 31 of the windlass 3 is forward so as to make the guy cable 35 coil around the drum 34, at the same time, via the fixed pulley 11, the guy cable 35 pulls the hollow cylinder 4 to slowly and upwards slide along the outside wall of the column 1, when the billboard stent 2 slides to the third limit switch, the third limit switch starts, the billboard stent 2 stops, the electromagnetic driver 16 gets power, the locking pin 15 retracts under the force of the magnetic attraction and disengages from the sliding path, then motor 31 of the windlass 3 starts to be backward so as to release the guy cable 35 from the drum 34, at the same time, via the fixed pulley 11, the guy cable 35 pulls the hollow cylinder 4 to slowly and downwards slide along the outside wall of the column 1, when the billboard stent 2 slides to the second limit switch, the second limit switch starts, the electromagnetic driver 16 gets power, the locking assembly opens, the billboard stent 2 continues to downwards slide. When the billboard stent 2 slides to the first limit switch, the first limit switch starts, the motor 31 of windlass 3 loses power. Here, the billboard stent 2 is located at the beginning position of the bottom of the column 1, if the wind speed measured by the anemoscope 6 is greater than or equal to the secure wind speed, the billboard stent 2 continues to stop, if the wind speed measured by the anemoscope 6 is always less than the secure wind speed in the delay time, entering the rising process of the billboard stent 2.

Figure 19:
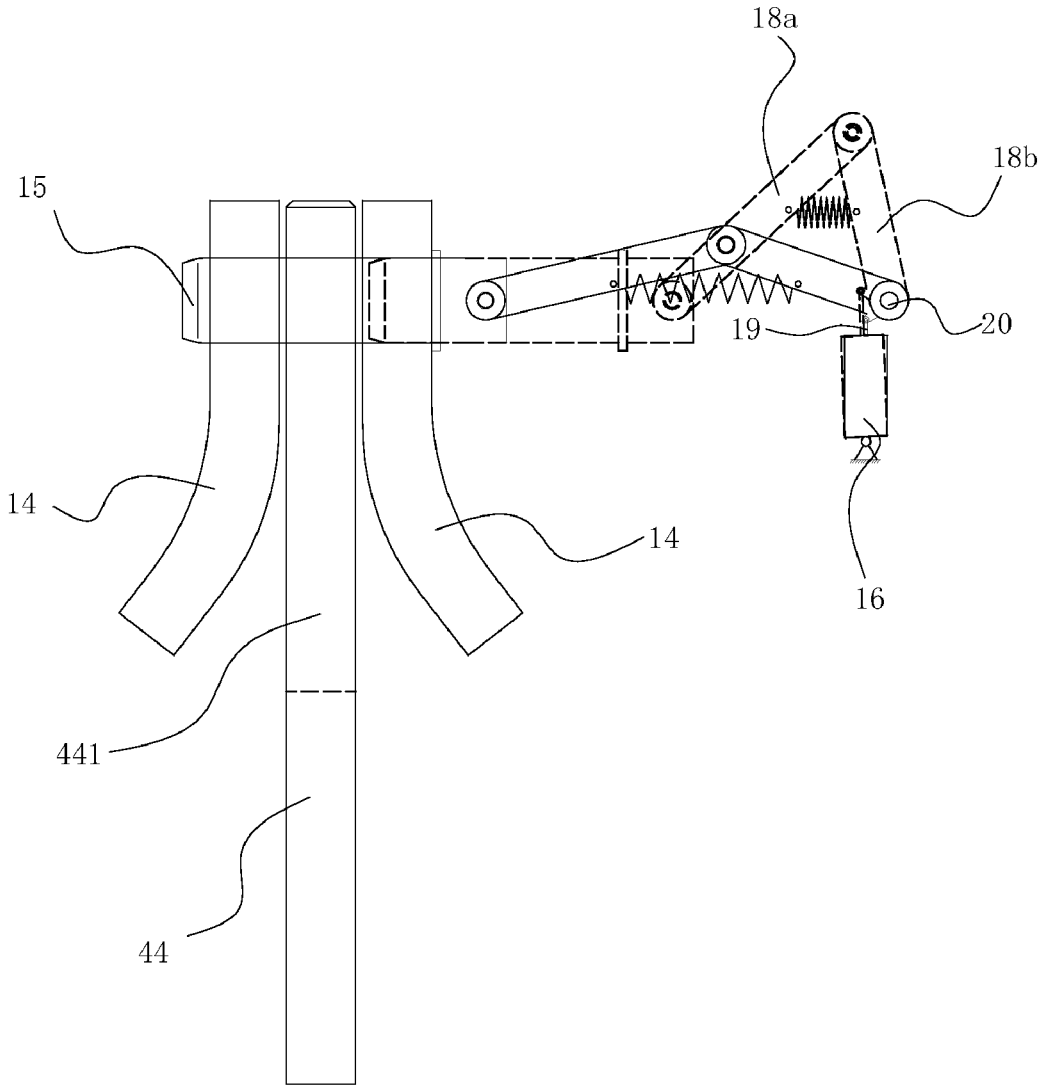
FIG. 19 is a structural schematic view of the locking assembly according to a second preferred embodiment of the present invention.

The second preferred embodiment of the present invention is illustrated, as shown in FIG. 19, which has a different locking assembly with respect to the above preferred embodiment, the locking assembly comprises two locating pieces 14 having a keyhole respectively, a fixed shaft 20, a locking pin 15, an electromagnetic driver 16, a spring 17, a first connecting rod 18*a* and a second connecting rod 18*b*, wherein the two locating pieces 14 is fixed on the outside wall the column 1, a sliding path is formed between the two locating pieces 14; a lockplate 44 is axially disposed on the inside wall of the hollow cylinder 4 and is capable of inserting into the sliding path, the lockplate 44 has an axial slotted hole 441 corresponding to the keyhole, the head of the locking pin 15 corresponds to the keyhole and the tail of the locking pin 15 connects with one end of the first connecting rod 18*a* by a hinge, another end of the first connecting rod 18*a* connects with one end of the second connecting rod 18*b* by a hinge, another end of the second connecting rod 18*b* rotationally connects with the fixed shaft 20, the fixed shaft 20 is fixed on the column 1, and two ends of the spring 17 respectively connect with a middle of the first connecting rod 18*a* and a middle of the second connecting rod 18*b* so as to create a separating tendency between the first connecting rod 18*a* and the second connecting rod 18*b*. Another end of the second connecting rod 18*b* also connects with a slide rod 19 which is controlled by the electromagnetic driver 16 and the spring 17, namely, when the electromagnetic driver 16 gets power, the slide rod 19 rises by the force of the magnetic attraction, when the electromagnetic driver 16 loses power, the restoring force of the spring 17 drives the first connecting rod 18*a* with respect to the second connecting rod 18*b*, and drives the slide rod 19 to fall at the same time, in other words, the spring 17 makes the slide rod 19 have a down movement tendency.

In use, when the lower half of the slotted hole 441 corresponds to two sides of keyhole, the electromagnetic driver 16 releases the locking pin 15 after the electromagnetic driver 16 loses power, under the restoring force of the spring 17, the slide rod 19 falls and drives the second connecting rod 18*b* to widdershins rotate along the fixed shaft 20 so as to drive the first connecting rod 18*a* to rotate, and drive the locking pin 15 to traverse the keyholes and the slotted hole 441 positioned between the two keyholes. And controlling the motor 31 of the windlass 3 to rotate backward to make the hollow cylinder 4 fall off a short distance so as to unload the load of the guy cable 35, at this point, the locking pin 15 contacts with the upper edge of the slotted hole 441, so that the weight of the billboard stent 2 entirely falls on the locking pin 15. Once the billboard stent 2 is needed to fall, by making the billboard stent 2 rise up a short distance to unload the load of the locking pin 15, and making the electromagnetic driver 16 get power, the locking pin 15 rises under the force of the magnetic attraction and drives the second connecting rod 18*b* to rotate along the fixed shaft 20 so as to drive the first connecting rod 18*a* to rotate, the first connecting rod 18*a* drives the locking pin 15 retract and disengage from the sliding path, such that the hollow cylinder 4 is capable of moving freely, as shown in FIG. 19.

Figure 20:
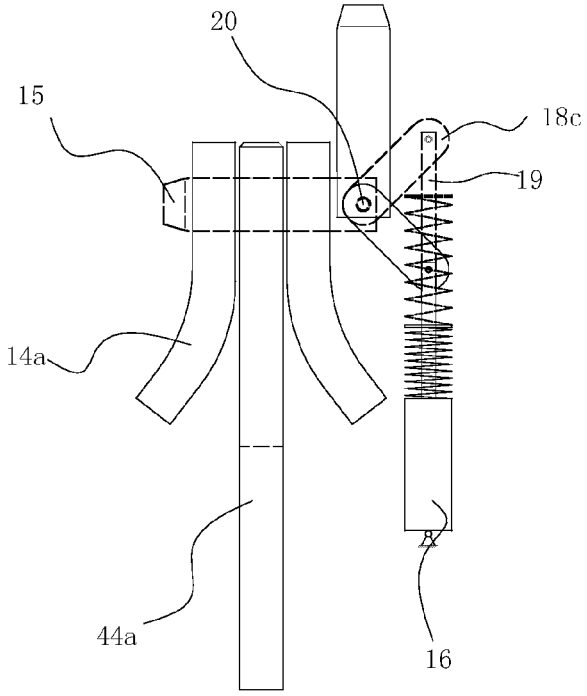
FIG. 20 is a structural schematic view of the locking assembly according to a third preferred embodiment of the present invention.
Figure 21:
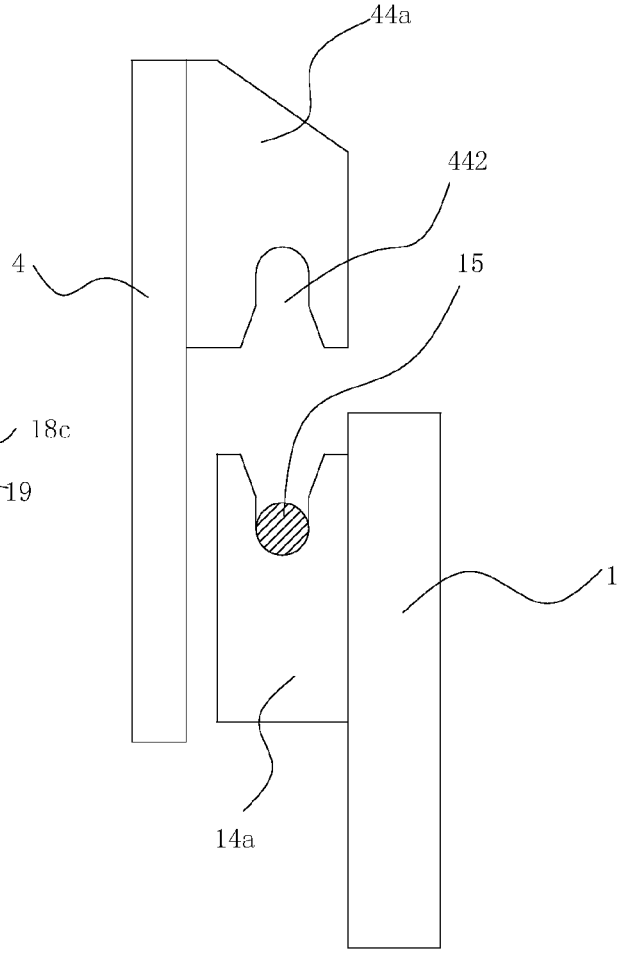
FIG. 21 is a left view of FIG. 20.
Figure 22:
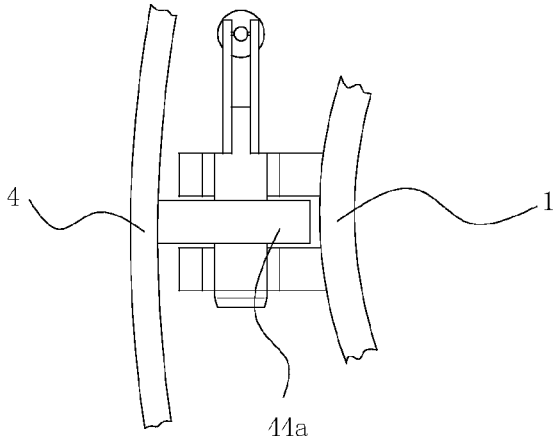
FIG. 22 is a top view of FIG. 21.

The third preferred embodiment of the present invention is illustrated, as shown in FIG. 20 to FIG. 22, which has a different locking assembly with respect to the above preferred embodiment, the locking assembly comprises two locating pieces 14*a*, a fixed shaft 20, a locking pin 15, an electromagnetic driver 16, a spring 17 and a connecting rod 18*c*, wherein the two locating pieces 14*a* are fixed on the outside wall the column 1, a sliding path is formed between the two locating pieces 14*a*, a locating groove is formed on a top of the locating piece 14*a*; a lockplate 44*a* is axially disposed on the inside wall of the hollow cylinder 4 and is capable of inserting into the sliding path, an axial elongated groove 442 corresponding to the locating groove is formed on a bottom of the lockplate 44*a*; one end of the locking pin 15 is fixed with the connecting rod 18*c*, the end of the locking pin 15 and the connecting rod 18*c* together connect with the fixed shaft 20, the shaft is fixed on the outside wall of the column 1; another end of the connecting rod 18*c* connects with the slide rod 19, the slide rod 19 has a barrier, a top of the spring 17 contacts with the barrier, a bottom of the spring 17 contacts with an encloser of the electromagnetic driver 16, such that the slide rod 19 always has a up movement tendency, at the same time, the slide rod 19 is controlled by the electromagnetic driver 16, namely, when the electromagnetic driver 16 gets power, the slide rod 19 falls and compresses the spring 17 under the force of the magnetic attraction; when the electromagnetic driver 16 loses power, the restoring force of the spring 17 drives the slide rod 19 to rise, in other words, the slide rod 19 is controlled by the electromagnetic driver 16 and the spring 17.

In use, when the axial elongated groove 442 of the lockplate 44*a* arrives to the top of the locating piece 14*a*, as shown in FIG. 21, the electromagnetic driver 16 releases the slide rod 19 after the electromagnetic driver 16 loses power, the slide rod 19 rises under the force of the spring 17 and drive the connecting rod 18*c* to widdershins rotate along the fixed shaft 20 so as to drive the locking pin 15 to widdershins rotate along the fixed shaft 20, such that the locking pin 15 is positioned in the locating groove of the locating piece 14*a*. And controlling the motor 31 of the windlass 3 backward to make the hollow cylinder 4 fall off a short distance so as to unload the load of the guy cable 35, at this point, the locking pin 15 contacts with the upper edge of the slotted hole 441, so that the weight of the billboard stent 2 entirely falls on the locking pin 15. Once the billboard stent 2 is needed to fall, by making the billboard stent 2 rise up a short distance to unload the load of the locking pin 15, and making the electromagnetic driver 16 get power, the slide rod 19 falls under the force of the magnetic attraction and drives the connecting rod 18*c* to deasil rotate along the fixed shaft 20 so as to drive the locking pin 15 to deasil rotate along the fixed shaft 20, the locking pin 15 deviates from the sliding path, such that the hollow cylinder 4 is capable of moving freely.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An elevating billboard, comprising:

a hollow column;

a billboard stent;

a windlass comprising: a motor, a forward relay controlling said motor to rotate forward and a backward relay controlling said motor to rotate backward;

a hollow cylinder fixed with said billboard stent and ringing said column so as to slide along said column up and down; and a fixed pulley disposed on a top of said column, wherein a free end of a guy cable on said windlass connecting with said hollow cylinder via said fixed pulley, wherein a locking assembly is disposed between said hollow cylinder and said column, such that when said hollow cylinder is positioned on a top of said column, said locking assembly bears as weight of said billboard stent, wherein said locking assembly comprises two locating pieces respectively having a keyhole and fixed on an outside wall of said column, a locking pin, an electromagnetic driver, and a spring, wherein a sliding path is formed between said two locating pieces, a lockplate is axially disposed on an inside wall of said hollow cylinder and is capable of inserting into said sliding path, said lockplate has an axial slotted hole corresponding to said keyhole, a head of said locking pin corresponds to said keyhole and a tail of said locking pin contacts with said spring, when said electromagnetic driver loses power, said locking pin inserts into said keyholes of said locating pieces, when said electromagnetic driver gets power, said locking pin disengages from said sliding path, wherein a first trigger switch is disposed on an outside wall of an lower end of said column and is capable of controlling said motor to stall while said hollow cylinder is falling, a third trigger switch is disposed on an upper end of said column, while said hollow cylinder is falling, said third trigger switch is capable of controlling said motor to stall and controlling said electromagnetic driver to lose power at the same time.

2. The elevating billboard, as recited in claim 1, wherein a second trigger switch is fixed on said outside wall of said column and is positioned lower than said locating piece, while said hollow cylinder is rising, said second trigger switch is capable of controlling said electromagnetic driver to get power.

3. The elevating billboard, as recited in claim 2, wherein said elevating billboard further comprises an anemoscope, a control assembly, wherein said control assembly controls said windlass and said electromagnetic driver with a wind speed signal, a control signal of said first trigger switch, a control signal of a second trigger switch and a control signal of said third trigger switch.

4. The elevating billboard, as recited in claim 3, wherein said control assembly comprises a control element, a signal conversion element, a fourth trigger switch controlling said billboard stent to rise, a fifth trigger switch controlling said billboard stent to fall, and an AND gate chip, wherein said first trigger switch and said fourth trigger switch respectively connect with two input port of said AND gate chip, an output port of said AND gate chip connects with a first signal input port of said control element, said second trigger switch connects with a second signal input port of said control element, said third trigger switch connects with a third signal input port of said control element, said fifth trigger switch connects with a fourth signal input port of said control element, said anemoscope connects with a fifth signal input port of said control element by said signal conversion element, said first trigger switch connects with a sixth signal input port of said control element, a first signal output port of said control element connects with said electromagnetic driver, a second signal output port of said control element connects with said forward relay of said windlass, a third signal output port of said control element connects with said backward relay of said windlass.

5. The elevating billboard, as recited in claim 3, wherein a power fixed contact is disposed on said upper end of said column, and a power movable contact which separably contacts with said power fixed contact is fixed on said hollow cylinder.

6. A control method of the elevating billboard recited in claim 5, comprising the steps of:

(1) predetermining a secure wind speed, a first delay time, a second delay time in said control assembly;

(2) judging whether a signal of said first input port of said control element is true, namely, judging whether said fourth trigger switch controlling said billboard stent to rise and said first trigger switch controlling said windlass to stall start at the same time; if yes, an output control signal of said control element makes said forward relay get power and makes said backward relay lose power, entering the rising process of said billboard stent; if not, entering the next step;

(3) judging whether a signal of said fifth input port of said control element is true, namely, judging whether said fifth trigger switch has started; if yes, the output control signal of said control element makes said forward relay get power and makes said backward relay lose power, entering the falling process of said billboard stent; if not, returning to the step (2).

7. The control method of the elevating billboard, as recited in claim 6, wherein in the step (2), the rising process of said billboard stent comprises the following steps of:

(21) judging whether a signal of said second input port of said control element is true, namely, judging whether said second trigger switch has started, if not, returning to the step (21); if yes, the output control signal of said control element makes said electromagnetic driver get power;

(22) judging whether a signal of said third input port of said control element is true, namely, judging whether said third trigger switch has started, if not, returning to the step (22); if yes, the output control signal of said control element makes said electromagnetic driver lose power and makes said forward relay lose power;

(23) making said backward relay get power with the output control signal of said control element;

(24) after the predetermined first delay time, making said backward relay lose power with the output control signal of said control element.

8. The control method of the elevating billboard, as recited in claim 7, wherein the rising process of said billboard stent further comprises the following step of: (25) reading a wind speed signal of said fifth input port with said control element, judging whether wind speed is greater than or equal to said secure wind speed, if not, returning to the step (25); if yes, entering the falling process of said billboard stent.

9. The control method of the elevating billboard, as recited in claim 6, wherein in the step (3), the falling process of said billboard stent comprises the following steps of:

(31) judging whether a signal of said third input port of said control element is true, namely, judging whether said third trigger switch has started, if not, returning to the step (31); if yes, the output control signal of said control element makes said electromagnetic driver get power so as to make said forward relay of said windlass lose power;

(32) making said backward relay of said windlass get power with the output control signal of said control element;

(33) judging whether the signal of a second input port of said control element is true, namely, judging whether said second trigger switch has started, if not, returning to the step (32); if yes, the output control signal of said control element makes said electromagnetic driver lose power;

(34) judging whether a signal of said sixth input port of said control element is true, namely, judging whether said first trigger switch has started, if not, returning to the step (34); if yes, the output control signal of said control element makes said backward relay of said windlass lose power.

10. The control method of the elevating billboard, as recited in claim 9, wherein the falling process of said billboard stent further comprises the following step of:

(35) reading a first wind speed of said fifth input port with said control element, judging whether the first wind speed is less than the secure wind speed, if not, returning to the step (35); if yes, turning on a timer which is predetermined with the second delay time, and entering the next step;

(36) reading a second wind speed of said fifth input port with said control element, judging whether the second wind speed is less than the secure wind speed, if not, returning to the step (35); if yes, entering the next step;

(37) judging whether said timer has expired, if yes, entering the rising process of said billboard stent; if not, returning to the step (36).

* * * * *